United States Patent [19]

Kobayashi et al.

[11] Patent Number: 4,572,393

[45] Date of Patent: Feb. 25, 1986

[54] CONTAINER WITH EASY OPEN TYPE CLOSURE

[75] Inventors: Koji Kobayashi, Iwatsuki; Keisuke Shimizu, Houya, both of Japan

[73] Assignees: Hokkai Can Co., Ltd., Tokyo; Snow Brand Milk Products Co., Ltd., Hokkaido, both of Japan

[21] Appl. No.: 704,857

[22] Filed: Feb. 25, 1985

[51] Int. Cl.[4] ..... B65D 41/32

[52] U.S. Cl. ..... 220/270

[58] Field of Search ..... 220/270, 276; 229/43 R

[56] References Cited

U.S. PATENT DOCUMENTS 4,256,239 3/1981 Yamaguchi et al. ..... 220/270

4,434,908 3/1984 French ..... 220/270

*Primary Examiner*—George T. Hall

*Attorney, Agent, or Firm*—Birch, Stewart, Kolasch & Birch

[57] ABSTRACT

An easy open type closure for a container having a closure member made of at least a metallic foil sheet for being affixed together with a ring-shaped member to an edge of an opening of a container barrel body. A first pull-opening member is provided having a first pulling tab connected to an initial end portion thereof and being connected to an upper surface of the closure member more firmly than a tearing strength of the closure member. A second pull-opening member is provided having a second pulling tab connected to an initial end portion thereof and being connected to an upper surface of the closure member more firmly than a tearing strength of the closure member. The first pull-opening member is formed of a strip member that extends in an annular form along an inner edge of the ring-shaped member and includes a final end portion directed towards the first pulling tab. The second pull opening member is formed of a strip member that extends in an annular form along an inner side edge of the first pull-opening member and includes a final end portion directed towards the first initial end portion thereof. In this manner, the closure may be partially opened or fully opened by using either the first pull-opening or the second pull-opening.

8 Claims, 8 Drawing Figures

CONTAINER WITH EASY OPEN TYPE CLOSURE

BACKGROUND OF THE INVENTION

1. Field of the Invention

This invention relates to an easy open type container wherein an opening is tightly sealed with a closure member made of at least a metallic foil and a pull-opening member is provided having an initial end portion connected to a pulling tab which is connected more firmly to an upper surface of the closure member than the tearing strength of the closure member. In this manner, the closure member can be torn open by way of the pull-opening member by pulling the pulling tab upwards in relation to the closure member.

2. Description of Background Art

As for a container of this kind, there has been hitherto proposed by the inventors of the present invention a closure as shown in FIGS. 7 and 8 disclosed, for instance, in Japanese Unexamined Utility Model Registration Application Publication Showa No. 57 (1982)-177932. A closure member a shown in FIGS. 7 and 8 is made of a single layer of metallic foil such as an aluminum foil or the like or a composite layer of lamination comprising metallic foil and a thermoplastic synthetic resin layer. The closure member a is applied to cover an opening of a container barrel body c and is affixed, by curling fastening or fusion adhesion, to an annular edge of the opening of the container barrel body c through a ring-shaped member b which is made of metal or synthetic resin. A pull-opening member f comprising an annular strip member made of thermoplastic synthetic resin or the like and having at its initial end portion a pulling tab e is affixed more firmly than a tearing strength of the closure member a to an area of an upper surface of the closure member a positioned inside an inner edge d of the ring-shaped member b by fusion adhesion or through an adhesive agent.

If, in order to tear the closure member a open, the pulling tab e is held between one's fingers and is pulled upwards in relation to the closure member a, an initial stage of a broken opening of the closure member a is made at a portion corresponding to the initial end g of an interconnection portion between the pull-opening member f and the closure member a. If the pulling tab e is further pulled upwards together with the pull-opening member f, the tearing of the closure member a is guided along a guide edge h of the pull-opening member f to reach the inner edge d of the ring-shaped member b, and at the same time the tearing is made along an inner side edge i of the pull-opening member f with an X point serving as a starting point of the tearing.

If the lifting of the pulling tab e is further continued, the tearing which has reached the edge d is advanced along the inner edge d, and at the same time the tearing made along the inside edge i is advanced until it goes nearly half round. However, the advancing of the tearing is discontinued when the center region of the closure member a is loosened or slackened. Accordingly, the subsequent tearing stress is concentrated only on the portion extending along the inner edge d. As a result, only the tearing along the inner edge d is continued to the end, so that a full opening of the container can be obtained.

However, when the pulling direction of the pulling tab e connected to the initial end of the pull-opening member f is not proper or when there is a poor adhesion to the closure member a at part of the inner side edge i of the pull-opening member f, it often happens that tearing along the inside edge i cannot be made smoothly or that the tearing advance is discontinued before it goes half way around the closure member. Consequently, there cannot be obtained a desired sufficient slackening of the closure member a. Accordingly, the tearing stress does not concentrate only on the opening edge d, and as a result a tearing of the closure member a is made at an intermediate area between the inner edge d and the pull-opening member f, and a piece of the closure member a remains unremoved at such a portion near the inner edge d' as the tearing is advanced about 180° turning degrees from the initial tearing opening portion as shown by imaginary lines in FIG. 7.

SUMMARY AND OBJECTS OF THE INVENTION

This invention has for its object to provide a container with an easy open type closure in which the foregoing inconveniences can be removed and the closure member made of at least a metallic foil can be fully torn open easily and accurately by way of the pull-opening member.

Another object of this invention is to provide a container of the above type in which in succession to the initial tearing opening along the inner edge of the ring-shaped member which is fixed, together with the closure member, to the edge of the container barrel body, the closure member can be torn open easily and completely to obtain a full opening of the container without leaving any remaining piece of the closure member along the entire inner edge of the ring-shaped member.

A further object of this invention is to provide a container of the above type in which the closure member is torn partially open by means of the pull-opening member and there is formed a partially opened closure member. In this embodiment an edge of the opening is used, when it is intended that the powder contents contained in the container barrel body are to be taken out with a spoon. In this manner the closure may be used for cutting a rounded spoonful of the poweder by slidably moving the spoon across the edge thereof. Thus, a cut spoonful of the contents in a definite amount may be removed from the container.

For attaining the foregoing purposes, the present invention provides a container with an easy open type closure characterized in that a closure member made of at least a metallic foil sheet is fixed, together with a ring-shaped member, to an annular edge of an opening of a container barrel body. A first pull-opening member is provided having a first pulling tab connected to an initial end portion thereof and a second pull-opening member is provided having a second pulling tab connected to an initial end portion thereof which are connected more firmly to an upper surface of the closure member than a tearing strength of the closure member. The first pull-opening member is formed of a strip member that extends in an annular form along an inner edge of the ring-shaped member and has a final end portion directed towards the first pulling tab. The second pull opening member is formed of a strip member that extends in annular form along with an inner side edge of the first pull-opening member and has a final end portion directed toward the initial end portion thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
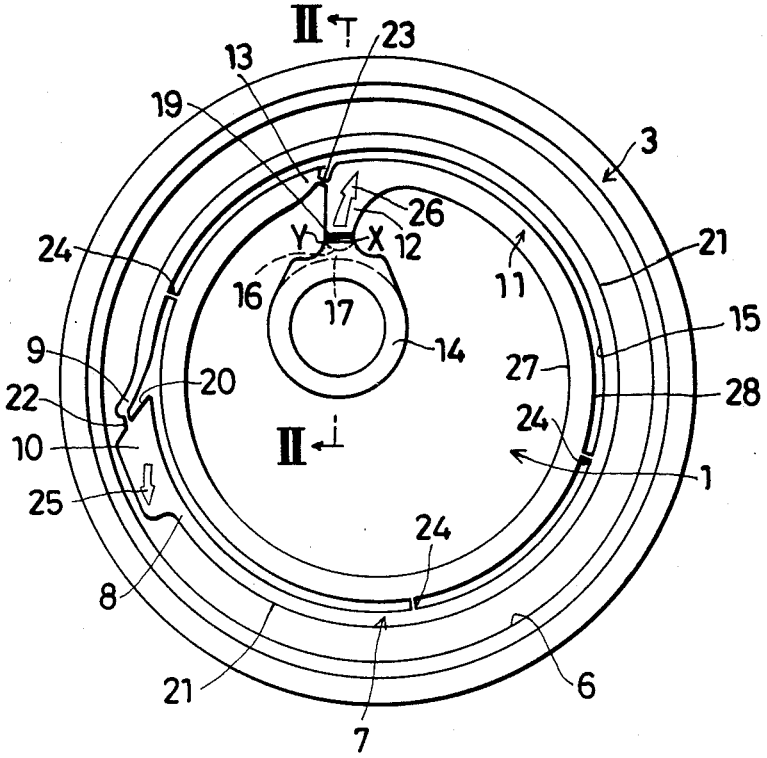
FIG. 1 is a top plan view of a container closure according to the present invention.
Figure 2:
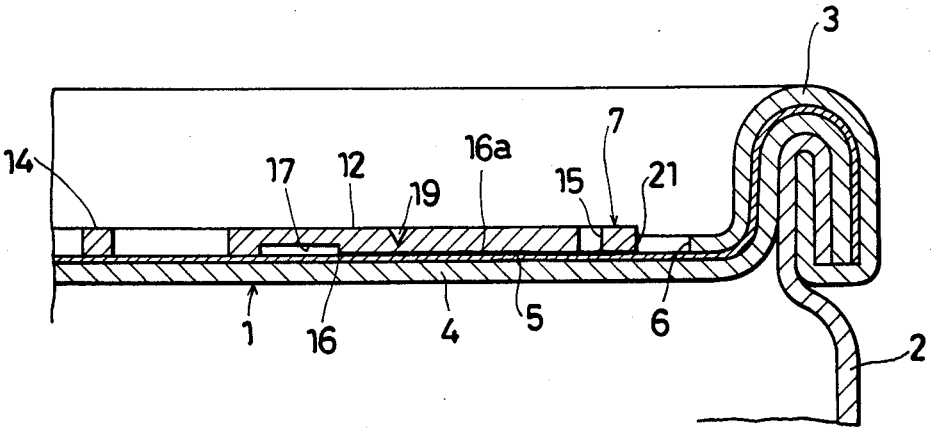
FIG. 2 is a sectional view taken along the line II—II in FIG. 1.

FIG. 1 is a top plan view of the container closure and FIG. 2 is a sectional view taken along the line II—II. A closure member 1 is fixed to an annular edge of an opening of a can barrel body 2 by means of a ring-shaped member 3. In more detail, the closure member 1 is made of a lamination of an aluminium foil 4 and a thermoplastic synthetic resin layer 5 affixed to an upper surface of the closure member 1. The closure member 1 is designed to cover an opening of the ring-shaped member 3 which is similar in shape to a flange portion of a usual can cover made of metal such as tin steel, a tin free steel or thermoplastic synthetic resin and is fixed through fusion adhesion to a resin layer 5 positioned on a rear surface of the member 3. The closure member 1 is fixed to the annular edge of the can barrel body 2 through the ring-shaped member 3 by tightly gripping them together. The closure member 1 may be made of a single layer of aluminium foil or plural layers of the same together with another kind of material layer. The fixing between the closure member 1 and the can barrel body 2 may be carried out by a process wherein the closure member 1 is directly fixed to the annular edge of the opening of the can barrel body 2 for covering the opening thereof and thereafter the ring-shaped member 3 is put on the closure member 1 and is fastened thereto.

A strip member 7 is made of the same material as the foregoing synthetic resin layer 5. The strip member 7 constitutes a first pull-opening member extending in an annular form and having an initial end portion 8 connected to a first pulling tab 10 and a final end portion 9 directing toward the first pulling tab 10. The first pulling tab 10 and the final end portion 9 are connected together so as to be separable from one another. The first pull-opening member 7 is provided so as to leave a desired space from the inner edge 6 of the ring-shaped member 3 and is affixed by fusion adhesion more firmly or stronger to an upper surface of the closure member 1 than a tearing strength of the closure member 1.

A strip member 11 is made of the same material as that of the first pull-opening member 7, that is, of the synthetic resin layer 5, and constitues a second pull-opening member extending in an annular form and having an initial end portion 12 and a final end portion 13 which is directed toward the initial end portion 12. The initial end portion 12 and the final end portion 13 are so connected together as to be separate from one another. In addition, the second pull-opening member 2 has a second pulling tab 14 in the form of a ring connected to the initial end portion 12 thereof. The second pull-opening member 11 is provided so as to leave a desired space from an inner side edge 15 of the first pull-opening member 7 and is affixed by fusion adhesion more firmly or stronger to the upper surface of the closure member 1 than the tearing strength of the closure member 1. As shown in FIG. 1, the positions of the final end portion 9 and the first pulling tab 10 of the first pull-opening member 7 are set so as to be adjacent to a middle portion of the second pull-opening member 11. This arrangement, as explained in detail thereafter, is for preventing an unfavorable possibility wherein the closure member 1 is broken open by pulling the second opening tab 14 of the second pull-opening member 11, the breaking of the closure member 1 caused by the second pull-opening member 11 may be advanced to the intermediate portion between the final end portion 9 and the first pulling tab 10 of the first pull-opening member 7.

An initial end portion 16 of an interconnection portion **16*a* is connected between the second pull-opening member 11 and the closure member 1. The initial end portion 16 is located at a position shown by broken lines in FIG. 1**.

It is sufficient if the second pulling tab 14 is positioned so as to be spaced from the upper surface of the closure member 1 or if it is adhered thereto so lightly as to be easily separable therefrom. The materials of the first pull-opening member 7 and the second pull-opening member 11 are not limited to the same as that of the foregoing synthetic resin layer 5, and any desired kind of material can be used as long as it is large in a tearing strength and a tensile strength.

The means for connecting thereof to the closure member 1 is not limited to the fusion adhesion, and is also sufficient with bonding with an adhesive agent which has a bonding strength which is more firmly than the tear strength of the closure member 1.

A thin part 17 of the pulling tab 14 is formed on a side of the second pulling tab 14 that is neighboring on the initial end 16 of the interconnection portion **16*a* formed between the second pull-opening member 11 and the closure member 1. The thin part 17 is connected to the end of the initial end portion 12 of the first pull-opening member 11 and is thinner than the second pull-opening member 11 so as to leave a space between the lower surface of the thin part 17 and the upper surface of the closure member 1. Thus, it is advantageous in that the second pulling tab 14 can be easily bent due to its thin part 17 when the second pulling tab 14 is raised and pulled upwards in the direction going remote from the closure member 1**.

A weakened part 19 is formed in the second pull-opening member 11 that is decreased in rigidity by making a recess therein. The weakened part 19 is made at such a position of the upper surface of the initial end portion 12 of the second pull-opening member 11 that corresponds to a position more or less advanced from the initial end 16 of the interconnection portion 16*a* between the second pull-opening member 11 and the closure member 1. In more detail, the recess is made, for instance, by a notch of about 0.5 mm in depth in a case where the thickness of the second pull-opening member 11 is about 1 mm, so that there is formed on the second pull-opening member 11 the weakened part 19 which is smaller in rigidity than the remaining entire part of the second pull-opening member 11. Accordingly, a region of the interconnection portion 16*a* between the second pull-opening member 11 and the closure member 1 that extends between the weakened part 19 and the initial end 16 of the interconnection portion 16*a* serves as an initial stage tearing opening region to be created when the closure member 1 is torn open by way of the second pull-opening member 11 by lifting the pulling tab 14.

A guide edge 20 is directed towards the inner edge 6 of the ring-shaped member 3 that is formed on the first pulling tab 10 so as to be located opposite to the final end portion 9 of the first pull-opening member 7 and thus when the closure member 1 is broken open by the second pull-opening member 11 the guide edge 20 may guide the breaking of the closure member 1 to advance towards the inner edge 6 of the ring-shaped member 3.

A connection member 22 is connected between the final end portion 9 of the first pull-opening member 7 and the first pulling tab 10 so as to be separable from one another as desired. A connection member 23 is connected between the initial end portion 12 and the final end portion 13 of the second pull-opening member 11 so as to be separable from one another as desired. A connection member 24 is connected between the first and second pull-opening members 7, 11 so as to be separable from one another as desired. Arrows 25 and 26 indicate the pulling directions of the first and second pulling tabs 10, 14.

Next, a process of opening of the container in the foregoing example will be explained as follows:

First, if the second pulling tab 14 for the second pull-opening member 11 shown in FIG. 1 is held by fingers and is pulled upwards the same may be bent at the thin part 17 to be raised easily to almost an upright posture. On this occasion, the upward pulling force of the second pulling tab 14 provides a large shearing force applied nearly perpendicularly to the horizontal closure member 1. If the pulling tab 14 is further pulled upwards, the initial end 16 of the interconnection portion 16*a* of the second pull-opening member 11 is lifted, by a lever action having its fulcrum at the weakened part 19 to result in breaking of the closure member 1 at the point corresponding to the initial end 16. Thus, the initial stage tearing opening of the closure member 1 can be easily obtained. In more detail, in the course of lifting the second pulling tab 14, there is generated a lifting force at such a portion of the closure member 1 that corresponds to the initial end 16 of the interconnection portion 16*a*, and there is created a shearing force between the foregoing lifting force and a resisting force for keeping the closure member 1 in its horizontal condition. Owing to the fact that since the second pull-opening member 11 is provided with the weakened part 19, the second pull-opening member 11 is decreased in its rigidity at the weakened part 19, the lifting force does not transmit to the whole of the remainder of the second pull-opening member 11. Therefore, the lifting force can be concentrated on the initial end of the second pull-opening member 11 about the weakened part 19 to provide the end with a large shearing stress. Thereby, an initial stage tearing opening of the closure member can be easily carried out.

Next, the subsequent tearing process after the initial stage tearing opening is effected will be explained as follows:

If, after the initial stage tearing opening is effected as mentioned above, the pulling tab 14 is further pulled upwards, the closure member 1 is given a subsequent tearing starting with a base point Y and advancing to reach the inner side edge 15 of the first pull-opening member 7. At the same time, the subsequent tearing starting with a base point X advances to reach the inner side edge 27 of the second pull-opening member 11. Thereafter, the foregoing outside tearing is advanced along the inner side edge 15, and at the same time, the foregoing inside tearing is advanced along the inner side edge 27 but is stopped when it reaches nearly a middle portion of the inner side edge 17 of the entire length of the second pull-opening member 11. The reason for discontinuation of the inside tearing is that there is generated a slackening of the closure member 1 at the center region thereof with the progress of the inside and outside tearings extending along the inner side edges 15 and 27. Consequently, the concentration of the tearing stress on a portion extending along the inner side edge 27 is dispersion. Accordingly, the tearing stress is concentrated only on a portion extending along the inner side edge 15 of the first pull-opening member 7. Thus, only the outside tearing is continued to the last to obtain such an accurate full opening of the container that there remains no portion of the closure member around the inner edge 6 of the ring-shaped member 3.

Figure 3:
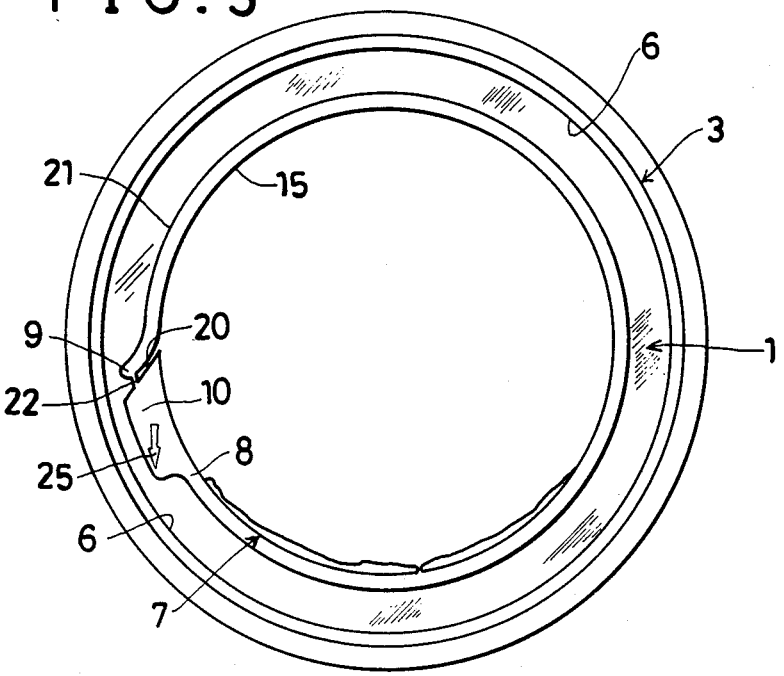
FIG. 3 is a top plan view thereof with a closure member being partly broken open.

In the foregoing tearing operation, if the manner of lifting of the second pull-opening member 11 is not proper, there remains part of the closure member left unremovable along a part of the inner side of the first pull-opening member 7, as shown in FIG. 3, for instance.

However, if the first pulling tab 10 for the first pull-opening member 7 is pulled upwards, due to the fact that a wide opening has already been made at the central region of the surface of the closure member 1, there is generated no dispersion of the tearing stress. Thus, the initial stage breaking opening caused by lifting the first pulling tab 10 is made along the guide edge 20 to reach the inner edge 6 of the ring-shaped member 3 and the subsequent breaking stress is concentrated on the inner edge 6 alone. A completely full opening of the closure member 1 can be obtained without leaving any remainder piece of the closure member 1 along the entire length of the inner edge 6.

As to the manner of use of the present invention, the foregoing subsequent breaking opening procedure by the first pull-opening 7 is not always carried out soon after the first opening procedure by the second pull-opening 11 is carried out. Namely, an alternative use of the closure may be carried out after the first breaking opening procedure by the second pull-opening member 11. In this manner, the contents contained in the container may be taken out under a partially open condition thereof as above, after a use thereof when the first pull-opening member 7 is open. In other words, the annular remainder surface of the closure member 1 becomes an obstruction to taking out a resultant amount less than the original contents.

Figure 4:
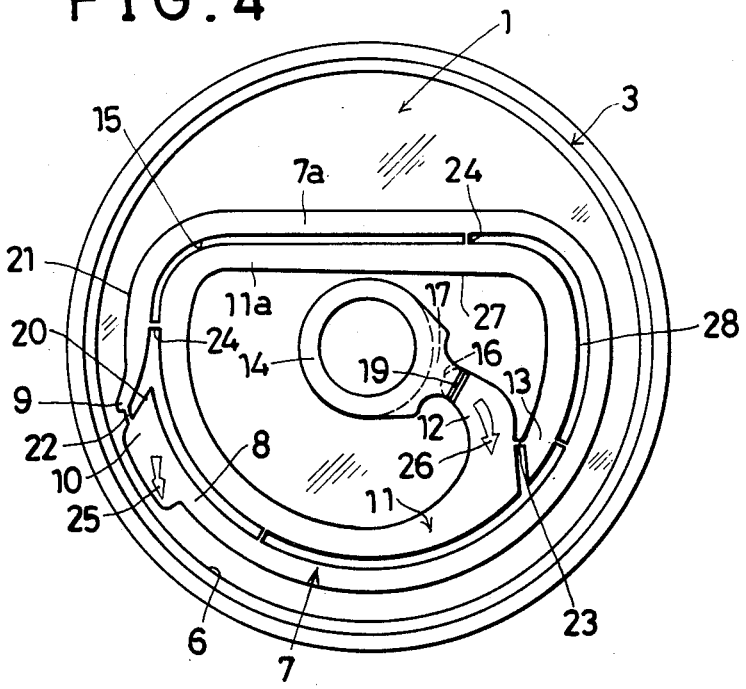
FIG. 4 shows a top plan view of another embodying example of this invention.

FIG. 4 is another embodiment of the present invention which is suitable for use when the container is partially opened only by means of the second pull-opening member 11 as mentioned above. The shape of the first and second pull-opening members 7, 11 are different from those of the above-discussed embodiment. However, the construction thereof is the same as the construction of the foregoing embodiment. As illustrated in FIG. 4, the first and second pull-opening members 7, 11 are formed at a middle portion in a straight line *7a*, 11*a*. Consequently, if the breaking opening of the closure member 1 is effected by means of the second pull-opening member 11, there is created an opening which is open along with the inner side edge 15 of the first pull-opening member 7. In this condition, the contents of the container may be taken out by a spoon. If the container contains powder or particles, the straight line part *7a* can serve as an edge for cutting the rounded spoonful of the contents by sliding the spoon thereacross. While the spoonful of the contents are being taken out from the container, to obtain a flat spoonful of the contents in a definite amount.

In the embodying example, in the breaking opening operation of the closure member 1 by the second pull-opening member 11, it may occasionally happen that there may remain a piece of the closure member 1 left unbroken on the inner side of the straight line part *7a* of the first pull-opening member 7 because the breaking along the inner side edge 27 of the second pull-opening member 11 is discontinued as a result of the center area region of the closure member 1 being in a slackened condition as the breaking thereof is advanced.

Figure 5:
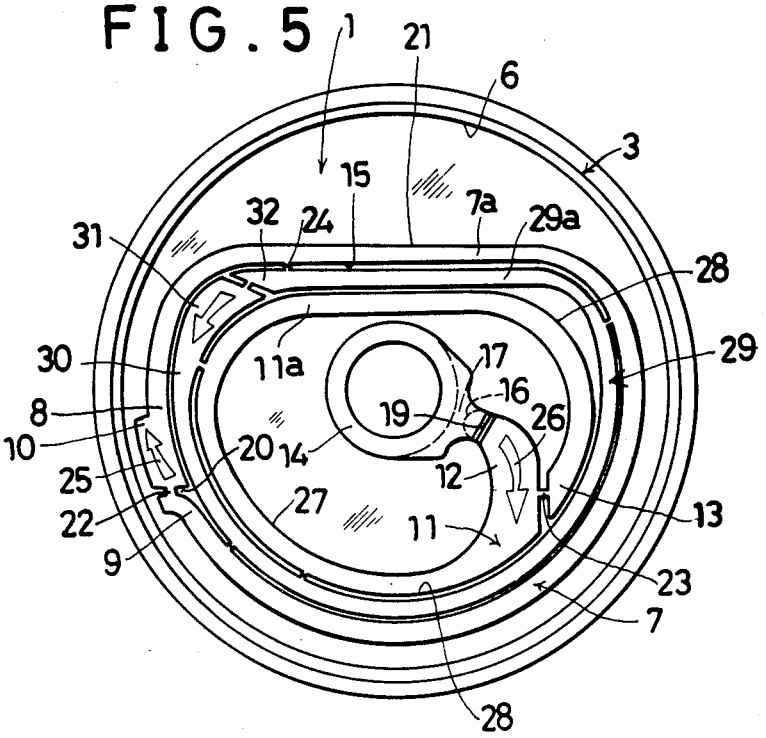
FIG. 5 is a top plan view of a modified example of the example shown in FIG. 4.

FIG. 5 is a modified example for eliminating such a generation of the remainder of the closure member 1 which is left unbroken as above. In this example, there is provided a third pull-opening member 29 between the inner side edge 15 of the first pull-opening member 7 and the outer side edge 28 of the second pull-opening member 11, and the other constructions are the same as those of the example in FIG. 4.

The third pull-opening member 29 is, similarly to the cases of the other pull-opening members 7, 11, formed of a strip member and is provided with a third pulling tab 31 connected to an initial end portion 30, and extends in an annular form and has a final end portion 32. The third pull-opening member 29 is connected more firmly to the upper surface of the closure member 1 than the tearing strength of the closure member 1, and the final end portion 32 and the third pulling tab 31 facing the same are so connected to each other as to be separable from each other, as desired.

With the above arrangement, when the closure member 1 is broken open by means of the second pull-opening member 11, even if there is left unbroken a remainder on a middle straight line part 29*a* of the third pull-opening member 29, when the breaking opening of the closure member 1 by means of the third pull-opening member 29 is then carried out. The tearing stress is not dissipated, but is concentrated on the inner side edge 15 of the first pull-opening member 7. Consequently, the breaking along the inner side edge 15 can be made accurate and smooth by the third pull-opening member 29 and there is left no remainding portion on the inner side edge 15*a*. Thereby, a rounded spoonful of the contents spooned up with a spoon can be accurately cut by sliding the spoon across that straight line inner side edge 15*a*, to obtain a flat spoonful of contents in a definite amount.

In a case where the container is not used for the foregoing slide cutting of the rounded spoonful of the contents, the breaking opening of the remainder of the closure member 1 may be enlarged by means of the first pull-opening member 7. Thereby, a full opening of the container can be obtained.

Figure 6:
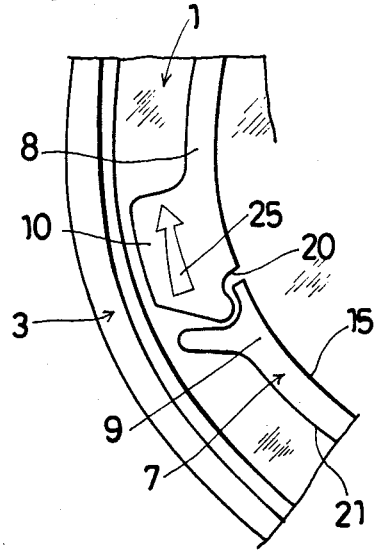
FIG. 6 is an enlarged top plan view of a part of a modified example of the example shown in FIG. 1.
Figure 7:
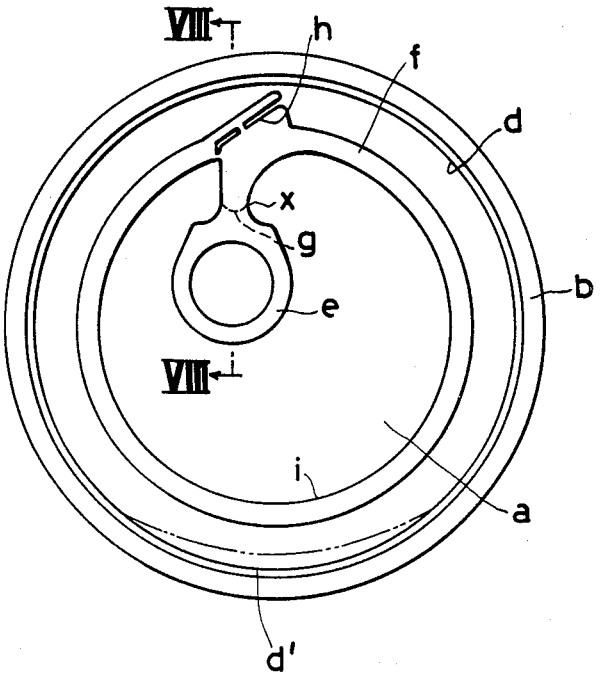
FIG. 7 is a top plan view of a conventional closure.
Figure 8:
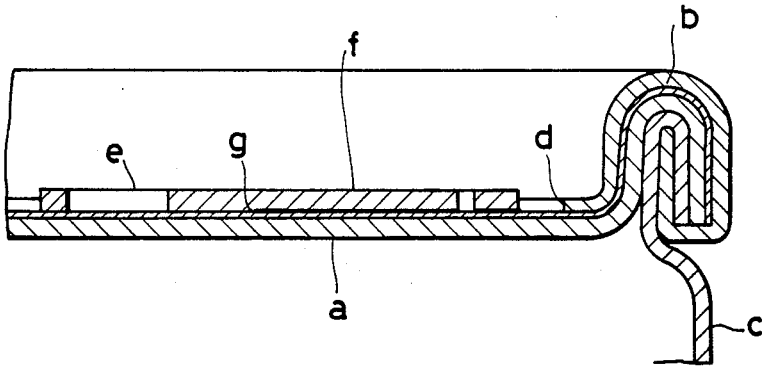
FIG. 8 is a sectional view taken along the line VIII—VIII in FIG. 7.

In the foregoing examples shown in FIGS. 1–5, the first pull-opening member 7, the second pull-opening member 11 and additionally the third pull-opening member 29 are opposite one to another in their respective pull-breaking directions. The reason for providing this mutually opposite breaking directional arrangement is, as explained with reference to the examples shown in FIG. 1 and FIG. 4, for example, that when the closure member 1 is being broken open along the inner side edge 15 of the first pull-opening member 7 by the second pull-opening member 11 the foregoing breaking thereof is prevented by this arrangement from advancing along the guide edge 20. Consequently, a breaking opening of the closure member is generated by the first pull-opening member 7. In other words, in the examples in FIG. 1 and FIG. 4, the foregoing preventive measure is achieved by such an arrangement that the foregoing guide edge 20 is formed on an inner side edge 15 side of the first pull-opening member 7 that serves as a guide when the broken opening of the closure member 1 is effected by the second pull-opening member 11. The guide edge 20 projects from the first pulling tab 10 so as to be directed toward a direction that is the same as the pull-breaking direction of the second pull-opening member 11 so that the breaking by the second pull-opening member 11 may not be advanced to the guide edge 20. In addition, as another preventive measure, if such an arrangement is made that is shown in a modified example in FIG. 6, the guide edge 20 is provided so as to be almost perpendicular to the inner side edge 15 of the first pull-opening member 7, for preventing the pull-breaking by the second pull-opening member 11 from advancing along the guide edge 20. In this embodiment, the pull-breaking directions by the first, second and third pull-opening members can be all in the same directions.

As will be clear from the above explanation, according to a first feature of the present invention, there is provided on the upper surface of the closure member for covering the opening of the container barrel body and sealing the same together with the ring-shaped member, a first pull-opening member having a first pulling tab connected to an initial end portion, and a second pull-opening member having a second pulling tab connected to an initial end portion. A strip member extends in an annular form along the inner edge of the ring-shaped member and has a final end portion which is directed towards the first pulling tab. The second pull-opening member is a strip member that extends in an annular form along the inner side edge of the first pull-opening member and a final end portion directed towards the initial end portion thereof. In this manner, an accurate full opening of the container can be achieved so that there is no remainder portion around the inner edge of the ring-shaped member of the closure member formed by an opening process. Thus, after the first broken opening of the closure member is carried out by the second pull-opening member, the broken opening of the closure member along the inner edge of the ring-shaped member by the first pull-opening member is carried out.

Additionally, according to another feature of the present invention, the position of the first pulling tab of the first pull-opening member and the position of the final end portion thereof are so set as to be adjacent to the middle portion of the second pull-opening member. Thus, when the breaking operation of the closure member is carried out by the second pull-opening member, the broken opening of the closure member by the second pull-opening member can be carried out without being broken at the intermediate gap portion of the surface of the closure member formed between the first pulling tab and the final end portion of the first pull-opening member and without adversely influencing the first pull-opening member. Furthermore, according to another feature of the present invention, a guide edge is formed on the first pulling tab of the first pull-opening member so as to be directed towards the inner edge of the foregoing ring-shaped member. Thus, an accurate broken opening of the closure member along the inner edge of the ring-shaped member by the first pull-opening member can be effected.

Furthermore, according to another feature of this invention, the respective middle portions of the first pull-opening member and the second pull-opening member are formed into respective straight line parts. Thus, the closure member can form a partial opening which has a straight line edge formed along the straight line part of the first pull-opening member when the closure member is broken open by the second pull-opening member. The opened straight line edge of the closure member along the straight line part of the first pull-opening member can be used for cutting a rounded spoonful of the contents of powders or particles which are being taken out with a spoon by sliding the spoon across the opening of the straight line edge to obtain a cut spoonful of contents in a definite amount to be taken out.

Furthermore, according to another feature of this invention, in the case where the straight line part of the first pull-opening member is used for the foregoing slide cutting of the rounded spoonful of the contents, there is provided, in addition to the first and second pull-opening members, a third pull-opening member having a third pulling tab connected to an initial portion, between the inner side edge of the first pull-opening member and the outer side edge of the second pull-opening member. The third pull-opening member is formed of a strip member that extends in an annular form and has a final end portion directed towards the third pulling tab. Thus, after the broken opening of the closure member by the second pull-opening member is carried out, if a further broken opening of the third pull-opening member is carried out, then a complete opening may be obtained around the inner side edge of the first pull-opening member leaving no remaining portion of the closure member.

Further, in the case where there is provided a third pull-opening member as above, the position of the third pulling tab of the third pull-opening member and that of the final end portion thereof are set to be located adjacent to the middle portion of the first pull-opening member and adjacent to the middle portion of the second pull-opening member. Thus, the pull-breaking operation of the second pull-opening members can be effected without having any influence on the third pull-opening member. In addition, the subsequent pull-breaking operation of the third pull-opening member can be effected without having any influence on the first pull-opening member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An easy open type closure for a container comprising:

a closure member made of at least a metallic foil sheet for being affixed together with a ring-shaped member to an edge of an opening of a container barrel body; and a first pull-opening member having a first pulling tab connected to an initial end portion thereof and being connected to an upper surface of the closure member more firmly than a tearing strength of the closure member;

a second pull-opening member having a second pulling tab connected to an initial end portion thereof and being connected to an upper surface of the closure member more firmly than a tearing strength of the closure member;

said first pull-opening member being formed of a strip member extending in an annular form along an inner edge of the ring-shaped member and includes a final end portion directed towards the first pulling tab;

said second pull opening member being formed of a strip member that extends in an annular form along an inner side edge of the first pull-opening member and includes a final end portion directed towards the first initial end portion thereof.

2. A closure according to claim 1, wherein the position of the first pulling tab and that of the final end portion of the first pull-opening member are set so as to be adjacent to a middle portion of the second pull-opening member.

3. A closure according to claim 1, wherein the first pulling tab of the first pull-opening member is provided with a guide edge formed on the first pulling tab so as to be directed toward the inner edge of the ring-shaped member.

4. A closure according to claim 1, wherein respective middle portions of the first pull-opening member and the second pull-opening member are formed into straight line parts which are in parallel with one another.

5. A closure according to claim 1, wherein a third pull-opening member having a third pulling tab connected to an initial end portion is interposed between the inner side edge of the first pull-opening member and an outer side edge of the second pull-opening member and is connected to the upper surface of the closure member more firmly than the tearing strength of the closure member, said third pull-opening member being formed of a strip member that extends in an annular form and has a final end portion directed toward the third pulling tab.

6. A closure according to claim 5, wherein the position of the third pulling tab and that of the final end portion of the third pull-opening member are so set as to be adjacent to a middle portion of the first pull-opening member and to a middle portion of the second pull-opening member.

7. A closure according to claim 4, wherein a third pull-opening member having a third pulling tab connected to an initial end portion is interposed between the inner side edge of the first pull-opening member and an outer side edge of the second pull-opening member and is connected to the upper surface of the closure member more firmly than the tearing strength of the closure member, said third pull-opening member being formed of a strip member that extends in an annular form and has a final end portion directed toward the third pulling tab.

8. A closure according to claim 1, wherein the closure member is affixed to a rear surface of the ring-shaped member in order to close an opening of the ring-shaped member, and is fixed through the ring-shaped member to the edge of the opening of the container barrel body.

* * * * *